US005448270A

United States Patent [19]

Osborne

[11] Patent Number: 5,448,270

[45] Date of Patent: Sep. 5, 1995

[54] INK-JET PRINTHEAD CAP HAVING SUSPENDED LIP

[75] Inventor: William S. Osborne, Vancouver, Wash.

[73] Assignee: Hewlett-Packard Company, Palo Alto, Calif.

[21] Appl. No.: 341,274

[22] Filed: Nov. 16, 1994

Related U.S. Application Data

[63] Continuation of Ser. No. 935,606, Aug. 26, 1992, abandoned.

[51] Int. Cl.[6] ..... B41J 2/165
[52] U.S. Cl. ..... 347/29
[58] Field of Search ..... 347/29

[56] References Cited

U.S. PATENT DOCUMENTS 5,146,243 9/1992 English et al. ..... 346/140 R
5,210,550 5/1993 Fisher et al. ..... 437/29

FOREIGN PATENT DOCUMENTS 0452119 10/1991 European Pat. Off. .
2929742 2/1981 Germany .

*Primary Examiner*—Benjamin R. Fuller
*Assistant Examiner*—Valerie Ann Lund

[57] ABSTRACT

An improved ink-jet printhead cap is described. In its preferred embodiment, the cap has a sealing lip, which extends peripherally around the generally planar expanse of the cap, the lip being suspended by a horizontal, resiliently deflectable, elastomer span that is supported on either end by vertical supports that define a channel dimensioned to receive partway therein the annular boss of a cap mount mounted on a sled. In cross section, the lip is centered above the channel, protrudes upwardly from an upper surface of the horizontal span, and tapers inwardly and upwardly substantially to a point, thus providing a conformable, focal impact point for sealingly engaging a printhead. The amount of force required to deflect the lip may be controlled by varying the thickness of the horizontal span and the distance between vertical supports.

8 Claims, 4 Drawing Sheets

INK-JET PRINTHEAD CAP HAVING SUSPENDED LIP

This is a continuation of U.S. application Ser. No. 07/935,606 filed on Aug. 26, 1992, now abandoned.

TECHNICAL FIELD

The present invention relates generally to improvements in cap design for capping the nozzle of an ink-jet printhead. More particularly, the invention concerns an improved cap having a suspended circumferential lip that better engages an ink-jet printhead's nozzle without undue force and without the cost and complexity of a spring-loaded gimbal-type mounting.

BACKGROUND ART

Ink-jet printhead nozzles often become plugged with dried ink particulate, unless they are kept in a humid environment. Commonly, an elastomer cap is placed over the nozzle end of a printhead to ensure a sufficiently humid environment to avoid such undesirable dried ink formation. Such a cap must form a leak-free seal between the printhead's nozzle and the ambient environment. Conventionally, this has been done in one of two ways: by forcing the elastomer cap into the printhead with enough force to deform the cap around its sealing lip, or by providing a spring-loaded gimbaling mechanism behind the cap to allow the cap's lip to "float" with the printhead. The former typically requires large forces to produce sufficient deformation to ensure a reliable seal, due to manufacturing tolerances. The latter typically requires less force, but adds a significant number of parts, thus increasing the cost and complexity of the cap mechanism. Neither is well-suited to multiple printhead ink-jet printer systems.

Certain improvements in ink-jet printhead capping mechanisms, more particularly to non-clogging configurations of a cap and a service station wherein the former sealingly engages an ink-jet printhead, have been proposed. Such are described in U.S. Pat. No. 5,027,134 entitled "Non-Clogging Cap and Service Station for Ink-jet Printers", which issued Jun. 25, 1991 and which is commonly owned herewith. The disclosure of that patent is incorporated herein by this reference.

DISCLOSURE OF THE INVENTION

The invented cap forms a reliable seal under low force comparable to that of the gimbaling mechanism, but without the added cost and complexity. It does so by having its sealing lip suspended by a horizontal elastomer span that is supported on either end by vertical supports. By suspending the lip on a horizontal span, the force required to deflect the lip a given amount is reduced over having a single vertical support mounting thereabove compliant lip, as in conventional cap assemblies. The amount of force required to deflect the lip may be controlled by varying the thickness of the horizontal span and the distance between vertical spans. Capping surface irregularities have little adverse impact on the reliability of the seal produced by the suspended lip cap mechanism of the invention. Multiple printhead cap assemblies can be mounted on a rigid sled, yet can accommodate relatively high inter-printhead manufacturing tolerances. The suspended lip cap significantly reduces manufacturing tolerance requirements, and thus lowers the cost of the cap assembly and of the ink-jet printer.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 2:
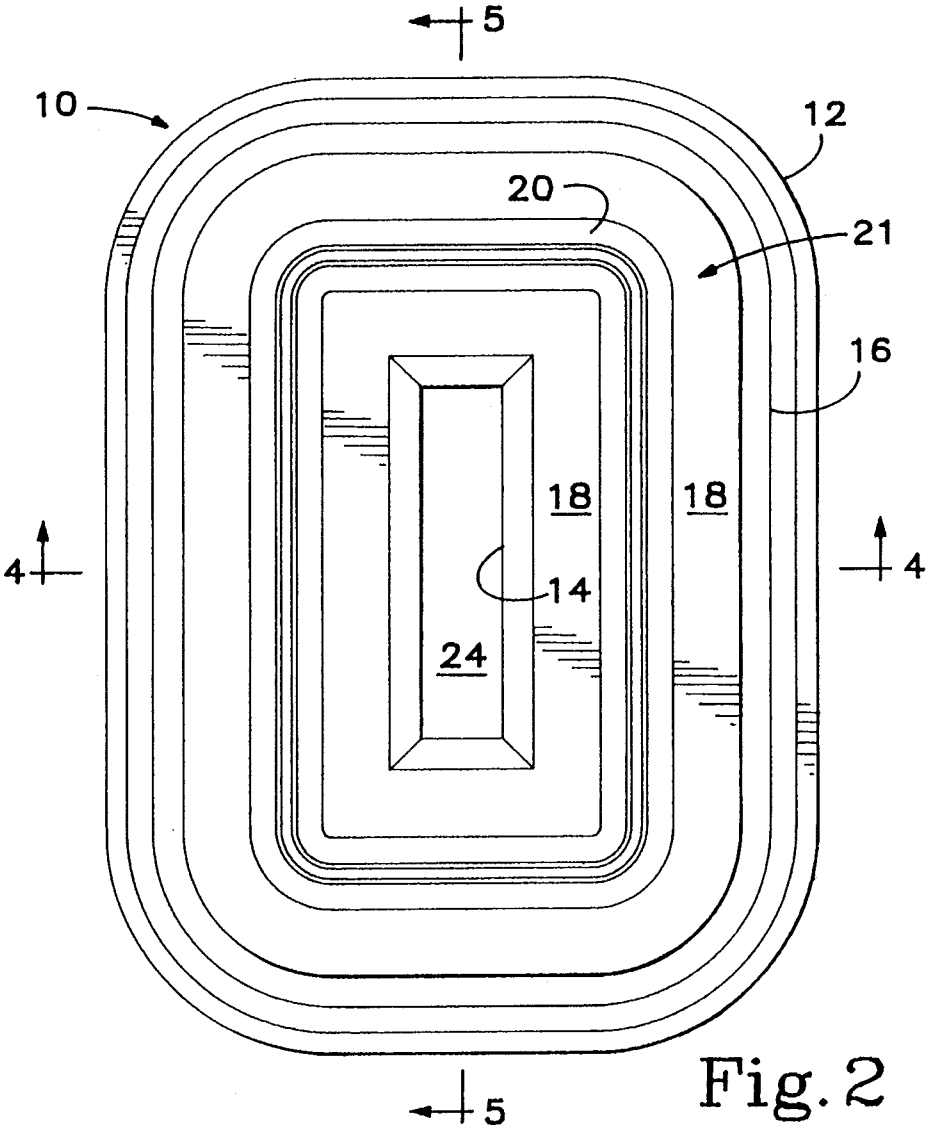
FIG. 2 is a front elevation of the cap shown in FIG. 1.
Figure 1:
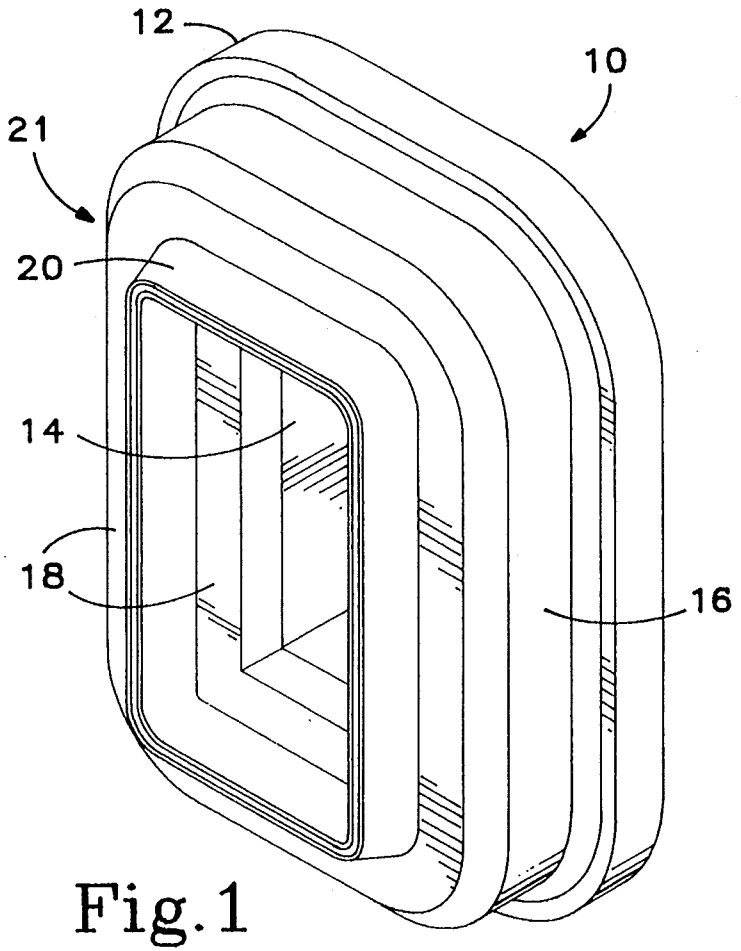
FIG. 1 is an isometric view of the ink-jet cap made in accordance with the preferred embodiment of the invention.
Figure 3:
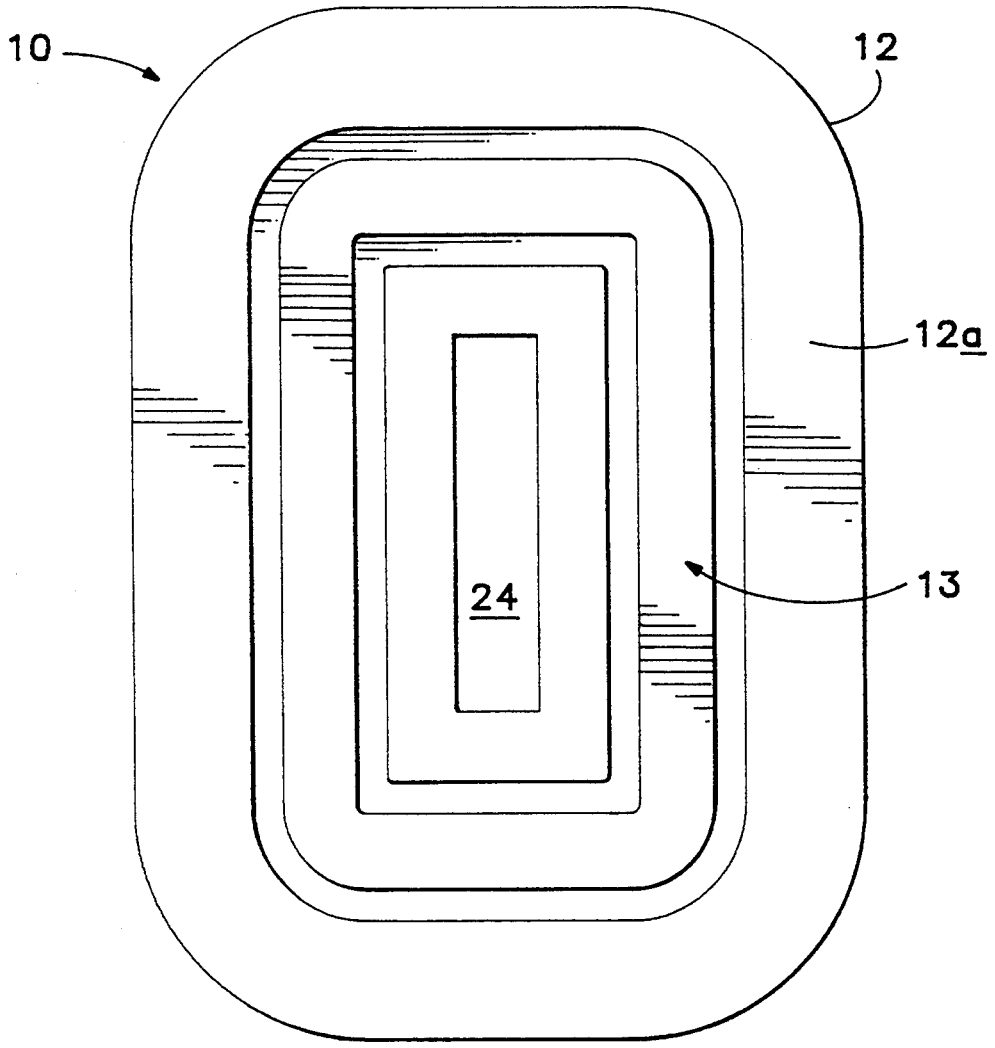
FIG. 3 is a rear elevation of the cap.

FIGS. 1, 2 and 3 collectively illustrate in isometric view a cap 10 for sealing the nozzle of an ink-jet printhead. Cap 10 in its preferred embodiment may be seen to include a first, generally planar expanse 12 having in its base region 12*a* a peripheral channel 13 dimensioned to receive a cap mount (not shown in FIGS. 1 through 5, but shown in FIG. 6) at least partly therein. By brief reference to FIGS. 4 and 5, channel 13 in cross section may be seen to have spaced, generally vertical, inner and outer support walls 14, 16 forming an interior and exterior sidewall of channel 13. Channel 13 also has a generally horizontal span or annular resiliently deformable second, expanse 18 extending between and connecting the upper extents of support walls 14, 16. Preferably horizontal second expanse 18 preferably is formed of a flexible material, e.g. an elastomer such as EPDM rubber, and is resiliently deflectable, e.g. downwardly, by a force F impacting on an upper periphery above channel 13 from an ink-jet printhead nozzle. It will be appreciated that the chamfered inner and outer surfaces of cap 10 facilitate its manufacture, e.g. by molding.

Importantly, in its preferred embodiment cap 10 further includes an upwardly extending or protruding lip, or lip region, 20 extending around the periphery of planar expanse 12. Lip 20 in cross section (refer to FIGS. 4 and 5) is substantially centered above channel 13, and in width is dimensioned less than the width of channel 13. It may now be appreciated that cap 10 is referred to herein as having a suspended lip, as lip 20 may be seen to be suspended by expanse 18 between walls 14, 16. Second expanse 18 and lip 20 will be referred to collectively herein as lip structure 21 (not indicated in FIGS. 3 through 6, for the sake of clarity, but indicated in FIGS. 1 and 2). Cap 10 also may be thought of as being a load-bearing, cross beam-type, cap.

Figure 4:
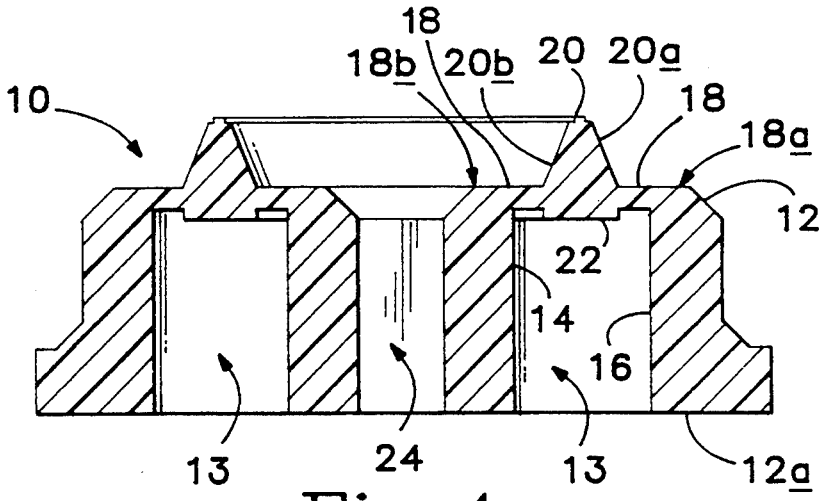
FIG. 4 is an enlarged, detailed, sectional view taken generally along the lines 4—4 of FIG. 2.
Figure 5:
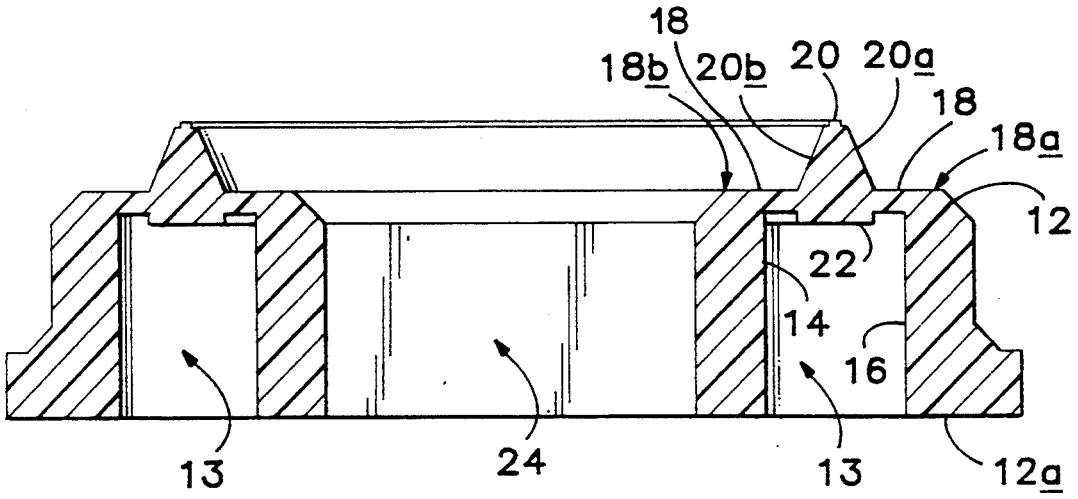
FIG. 5 is an enlarged, detailed, sectional view taken generally along the lines 5—5 of FIG. 3.

As may be seen best from FIGS. 4 and 5, lip 20 preferably tapers in cross section upwardly and inwardly substantially to a point in what may be described as a generally triangular cross-sectional configuration. It will be appreciated that in minute cross-sectional detail, generally triangularly cross-sectional lip 20 has at its apex a rectilinear protuberance, that is shaped and dimensioned to provide a focal impact point for the generally planar ink-jet's printhead, thereby to sealingly engage it, as shown.

Figure 6:
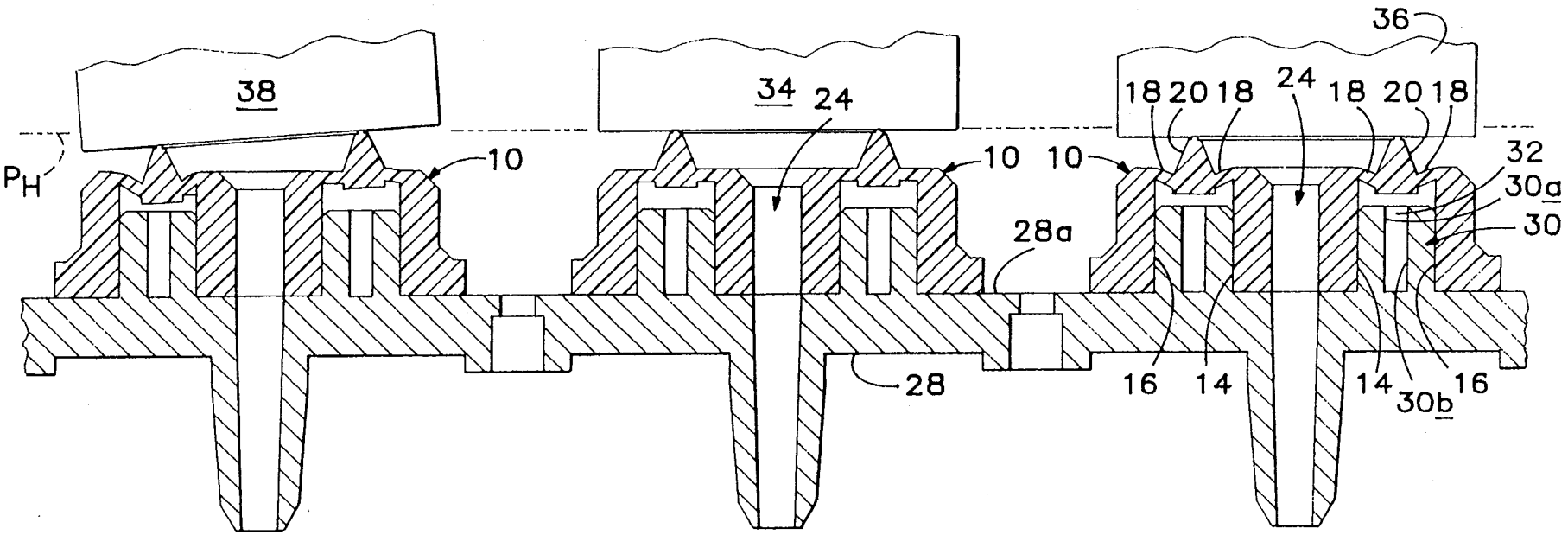
FIG. 6 is a front sectional view of plural caps mounted on their cap mounts with corresponding ink-jet printhead nozzles impacting thereon, and illustrates some of the advantages of the invention.

Lip region 20 is shaped and dimensioned nominally to sealingly engage a printhead of an ink-jet printer, as will be seen by reference to FIG. 6. Lip 20 is preferably substantially, and most preferably completely, peripherally coextensive with horizontal span 18. Lip region 20 may be seen, perhaps best from FIGS. 4 and 5, to include an inwardly inclined surface 20*a* and an outwardly inclined surface 20*b* that meet to define the apex of the triangle that is located substantially halfway between an inner peripheral edge 18*b* and outer peripheral edge 18*a* of span 18. It will be appreciated that, although the apex of triangularly cross-sectioned lip region 20 is described herein as being substantially a point, in fact it is rectilinear in minute cross-sectional detail, as shown, thereby providing a conformable focal impact point for the force of the printhead impacting thereon.

Referring still to FIGS. 4 and 5, span 18, which preferably is approximately 3.5 mm wide (left-to-right span in FIGS. 4 and 5), preferably includes a raised region 22 beneath lip region 20 and extending downwardly from span 18. Raised region 22 preferably is substantially, and most preferably is completely, peripherally coextensive with lip region 20, as may be seen by brief reference to FIGS. 2 and 3. Together, lip region 20 and raised region 22 form a central peripheral region of span 18 that is thicker than, e.g. preferably approximately three times the thickness of, the inner and outer region of the span immediately adjacent the central region, which preferably each are only approximately 0.5 mm thick. Raised region 22 alone, as well as together with lip region 20, effectively stiffens span 18 in a central region thereof, thereby better to maintain the nominal, substantially horizontal orientation of span 18 and the substantially vertical orientation of triangular lip region 20. Those of skill will appreciate that the static and dynamic responsiveness of cap 10 a force impacting thereon may be varied by adjusting such thickness and width dimensions of span 18, as by adjusting the spacing between support walls 14, 16.

Importantly, because span 1–8 (along with lip region 20 and raised region 22) is made of a resiliently deformable material such as EPDM rubber, forces impacting at the apex, or upper terminal extent, of lip region 20 are borne primarily by the inner and outer regions of span 18 immediately adjacent the central region thereof formed by lip region 20 and central region 22. Under normal static and dynamic forces impacting on lip region 20, these inner and outer regions of span 18 temporarily are flexed out of their nominal position and orientation shown in FIGS. 4 and 5. This temporary flexure permits lip region 20 along its substantial peripheral extent around cap 10 to sealingly engage the substantially planar lower surface of an ink-jet printhead.

The generally planar expanse 12 of cap 10 may be seen by reference to FIGS. 2 and 3 to be annular. Thus expanse 12 will be referred to also as a peripheral expanse defining a hole 24 centrally located therein and extending therethrough. Preferably substantially, and most preferably completely, throughout its peripheral extent, this expanse may be seen to be defined by a pair of spaced, generally vertical walls 14, 16 connected near their upper extreme by span 18. Inner and outer vertical walls 14, 16 and span 18 may be seen by reference to FIGS. 4 and 5 to define peripheral channel 13 in base 12*a* of the expanse. As will be, seen now by reference to FIG. 6, base channel 13 permits cap 10 to be mounted on a cap mount structure similar to that which is described in U.S. Pat. No. 5,027,134.

An important advantage of the invention is realized by invented cap 10, even by its use in a single printhead ink-jet printer. Invented cap 10 realizes the object of reducing the vertical force required to produce vertical deflection that promotes sealing eagagement of the printhead impacting thereon. Empirically, it has been determined that an interference fit, or vertical deflection, as great as 0.5 mm is produced by vertical loads as small as 250 g. This represents a significant improvement over conventional printhead capping subsystems in which significantly greater vertical loads are required to produce interference fits that are adequate to seal the printhead. It has also been determined that the cap structure described herein produces a relatively linear interference versus load relationship thus rendering the invented cap and capping subsystem much more predictably responsive over a wide range of vertical loads placed thereon. (Empirical data further indicates that the force-interference slope of this linear function is approximately 500 g/mm).

INDUSTRIAL APPLICABILITY

Turning finally to FIG. 6, cap 10 will be described in terms of its mounting structure within an ink-jet printer. Shown in FIG. 6 in somewhat simplified front elevation is a plural-printhead capping subsystem that includes plural caps 10 made in accordance with the invention. It will be appreciated that, although the subsystem shows only three caps and their respective cap mounts and printheads, any number of printheads may be sealed by a corresponding number of invented caps. The capping subsystem includes a relatively stiff frame member, or sled, 28 mounting an array of plural cap mounts 30 on an upper planar surface 28*a* of the sled.

Plural caps 10 may be seen to cover, i.e. to form a mating, interference fit with, corresponding ones of plural cap mounts 30. Peripheral channel 13 of each cap 10 is dimensioned to receive partly therein an upwardly extending annular boss region of cap mount 30. Importantly, channel 13, the depth of which is defined by interior and exterior sidewalls 14, 16, is deeper than the height of cap mount 30 above surface 28*a* of sled 28. This relative dimensioning between channel 13 and the boss region of mount 30 produces a defined space underneath span 18 which permits span 18 resiliently to be deflected downwardly by a force impacting on an upper periphery of cap 10 above channel 13. Preferably, this upper periphery includes lip region 20 having the described, triangular cross-sectional shape, which has been determined advantageously to focus and distribute such a force.

The boss region of cap mount 30 preferably includes upwardly extending inner and outer, substantially vertical walls 30*a*, 30*b* having a predefined first height that defines therebetween a peripheral channel 32 within the boss region of cap mount 30, although it will be appreciate that the boss need not have such a channel therein. Walls 14, 16 of cap 30 extend downwardly immediately interior and exterior of inner and outer walls 30*a*, 30*b* of cap mount 30 to meet frame member 28. Support walls 14, 16 of cap 30 are dimensioned to have a second height that is greater than the predefined first height of walls 30*a*, 30*b*. With cap 10 covering the boss region of cap mount 30, as illustrated in FIG. 6, the above-described space exists between the upper extent of walls 30a, 30b and the lower surface of horizontal expanse 18 of cap 30.

FIG. 6 illustrates one of the primary advantages of the invention by which plural printheads 34, 36, 38—which due to manufacturing tolerances may be at slightly different elevations or orientations relative to sled 28—nevertheless are sealed by corresponding caps 10. Nominally, the upper extents of caps 10 covering mounts 30 mounted on sled 28 define a horizontal plane $P_H$. If the lower extents of printheads 34, 36, 38 are coplanar with one another and coplanar with horizontal plane $P_H$, then when the capping subsystem is moved into its capping position shown in FIG. 6, printheads 34, 36, 38 will be sealed by caps 10. (Those skilled in the arts will appreciate that, for interference fit therebetween, preferably printheads 34, 36, 38 actually would define a plane slightly below plane $P_H$. Notwithstanding this slight interference or compression fit, the planes nominally formed by the printheads 34, 36, 38 and caps 10 will be referred to herein as being coplanar).

If, due to manufacturing tolerances, printheads 34, 36, 38 fail to define a plane or fail to define a plane that is coplanar with horizontal plane $P_H$ defined by the upper extents of the caps used to seal the printheads, then there will be a failure to seal the printheads, which may result in their clogging. By the use of invented caps 10 having resiliently deformable spans 18 that support and suspend lips 20, the sealing of plural printheads 34, 36, 38 is possible, despite the imprecise positioning or alignment thereof.

Illustratively, the working surface, or lower, planar expanse containing an array of ink-jet nozzles of printhead 34 may be seen to be coplanar with horizontal plane $P_H$. That is, printhead 34 precisely is positioned and oriented to matingly engage cap 10 therebeneath, and span 18 and lip 20 of this cap 10 remain in their nominal, unflexed shape.

The lower expanse of printhead 36, on the other hand, may be seen to extend slightly below horizontal plane $P_H$. With a conventional cap therebeneath, lacking the invented resiliently deformable span 18 having an upper periphery for sealingly engaging the printhead, there would be sealing of printhead 36, but there likely would be no sealing, or at best only incomplete sealing, of printheads 34, 38, even assuming sled 28 were spring-load mounted to yield to printhead 36. Nevertheless, by the use of cap 10, printhead 36 which extends below horizontal plane $P_H$ is sealingly engaged by the yielding flexure of horizontal span 18 occasioned by the downward force imparted on lip region 20 by printhead 36. Moreover, printheads 34, 38 sealingly are engaged also, yet without complicating the mounting of sled 28, as by a spring-loaded gimbaling mechanism.

Printhead 38, the lower expanse of which is nominally in horizontal plane $P_H$ is misaligned slightly, e.g. it is slightly inclined from the horizontal. Again, a conventional cap would not sealingly engage such a misaligned printhead 38. The invented cap 10 is able sealingly to engage inclined printhead 38 by the illustrated flexure in span 18 into a plane that substantially corresponds with that of printhead 38.

It will be understood that, because of the resilient material from which they are made, caps 10 return to their nominal, unflexed shape such that lips 20 once again define horizontal plane $P_H$. Thus, if a printhead in a multi-printhead ink-jet printer is serviced in,the field, e.g. by replacement, it yet can be sealed by the invented capping subsystem over a relatively wide range of positional and orientational tolerances. Accordingly, plural printhead ink-jet printers may be manufactured with less stringent tolerances, and at much lower cost, yet without adversely impacting their reliability and performance.

While the present invention has been shown and described with reference to the foregoing operational principles and preferred embodiment, it will be apparent to those skilled in the art that other changes in form and detail may be made therein without departing from the spirit and scope of the invention as defined in the appended claims.

I claim:

1. A cap for sealing the nozzle of an ink-jet printhead having a working surface lying in a plane, the cap comprising:

a generally planar first expanse including a base region and having in said base region a peripheral channel of defined width, said channel having dimensions that enable said channel to receive a cap mount partway therein, said channel in cross section having spaced support walls having terminal extents, said support walls forming an interior and exterior sidewall of said channel and having a lip structure extending peripherally around a perimeter of said first expanse in a plane substantially parallel with the plane of the working surface, said lip structure extending between and connecting said terminal extents of said support walls, said lip structure defining a planar peripheral printhead seal, said lip structure being formed of a flexible material and being resiliently deflectable by the planar working surface, for parallel planar alignment with the planar working surface, of an ink-jet printhead for sealing engagement of the printhead by said cap.

2. The cap of claim 1, which further comprises a protruding lip extending along said lap structure, said lip in cross section being substantially centered above said channel and in width being dimensioned less than said width of said channel.

3. The cap of claim 2, wherein said lip tapers in cross section substantially to a point thereby defining in cross section a triangular lip structure.

4. The cap of claim 1, wherein said lip structure tapers in cross section substantially to a point located approximately halfway between said interior and said exterior edges of said lip structure.

5. The cap of claim 4, wherein said lip structure includes a raised region within said channel, said raised region being substantially peripherally coextensive with said lip structure, said lip structure and said raised region forming a central peripheral region of said lip structure that is substantially thicker than said into and said exterior edges of said lip structure immediately adjacent said central peripheral region.

6. A capping subsystem for an ink-jet printer having plural printheads mounted to a base of the printer in a generally planar array, the printheads having lower generally planar working surfaces that are sealably engageable by upwardly extending caps positioned beneath the printheads, the subsystem comprising:

a stiff frame member mounting plural cap mounts in a plane generally parallel with the plane of the array of plural printheads, and plural caps covering said plural cap mounts, each cap including a first substantially planar expanse having a peripheral channel dimensioned to receive a cap mount partway therein, said channel including interior and exterior sidewalls and further including a flexible lip structure extending between and connecting with said sidewalls at interior and exterior edges of said lip structure corresponding respectively with said interior and exterior sidewalls, said lip structure extending substantially around a perimeter of each of said caps and defining a planar peripheral printhead seal, said lip structure being resiliently deflectable by the planar working surface, for co-planar alignment with the planar working surface, of each ink-jet printhead for sealing engagement of the printheads by each of said corresponding caps.

7. The capping subsystem of claim 6, wherein each of said cap mounts has an annular boss dimensioned for interference fitting within said channel of a corresponding one of said plural caps, each of said bosses extending only partway into a corresponding one of said channels, thereby forming a defined space between the farthest extent of said boss and said lip structure.

8. A cap for sealing the nozzle of an ink-jet printhead having a planar working surface, the cap comprising:

an annular member including an annular base with an open channel formed therein, said channel being bounded by spaced annular inner and outer sidewalls extending annularly along said member and an end structure including a resiliently deformable annular expanse extending annularly along said member in a plane that is substantially parallel to the plane of the working surface of the printhead, said annular expanse connecting between said sidewalls, said expanse including a substantially planar annular lip extending annularly along said member for sealingly engaging the working surface of an ink-jet printhead when said member is urged toward said printhead with said resiliently deformable annular expanse flexing in response to contact between said lip and said printhead to position and orient said lip in co-planar interference-fitted relationship with the working surface of the printhead, said annular expanse returning to its nominal unflexed configuration thereafter, said annular lip forming a conformable printhead nozzle-sealing structure.

* * * * *